United States Patent [19]

Rodskier et al.

[11] Patent Number: 5,049,097

[45] Date of Patent: Sep. 17, 1991

[54] STEERING SHOCK ABSORBER FOR BOAT PROPELLER DRIVE UNITS

[75] Inventors: Christian Rodskier, Torslanda; Kjell Borgersen, Hjälteby, both of Sweden

[73] Assignee: AB Volvo Penta, Goteborg, Sweden

[21] Appl. No.: 512,384

[22] Filed: Apr. 20, 1990

[30] Foreign Application Priority Data

Apr. 20, 1989 [SE] Sweden ..... 8901436

[51] Int. Cl.[5] ..... B63H 1/15

[52] U.S. Cl. ..... 440/52; 440/63; 440/53

[58] Field of Search ..... 114/144 R, 150, 170, 114/172; 440/52, 53, 55, 57, 61, 113, 900

[56] References Cited

U.S. PATENT DOCUMENTS

| | | | |
|---|---|---|---|
| 630,973 | 8/1899 | Christensen | 114/171 |
| 3,107,644 | 10/1963 | Munson | 440/52 |
| 3,148,657 | 9/1964 | Horning | 114/150 X |
| 3,202,125 | 8/1965 | Morse | 440/62 |
| 4,177,747 | 12/1979 | Pichl | 440/52 |
| 4,227,481 | 10/1980 | Cox et al. | 440/61 |
| 4,645,463 | 2/1987 | Arneson | 440/57 |

FOREIGN PATENT DOCUMENTS

| | | |
|---|---|---|
| 1141599 | 2/1983 | Canada . |
| 2584371 | 1/1987 | France . |
| 59-143797 | 8/1984 | Japan . |
| 2132962 | 7/1984 | United Kingdom . |

*Primary Examiner*—Ed Swinehart

*Attorney, Agent, or Firm*—Young & Thompson

[57] ABSTRACT

A shock absorber for absorbing external momentary steering forces acting on a steerable stern drive for boats. The shock absorber (11) is a hydraulic piston-cylinder device which is articulated between the anti-cavitation plate (9) of the drive (3) and a fixed portion (4) of the boat.

3 Claims, 2 Drawing Sheets

STEERING SHOCK ABSORBER FOR BOAT PROPELLER DRIVE UNITS

The present invention relates to a device for boats with steerable propeller drives for absorbing momentary external steering forces acting on the steering components of the drive.

Stern drives, so-called inboard-outboards, which are used with engines of more than 300 horse power and are equipped with single propellers designed to provide maximum performance at extremely high speed ranges, e.g. upwards of 50 knots, are subjected to exceptional stresses even when operating in relatively small waves. When the propeller returns to the water after leaving it in a wave through, short force pulses act transversely to the drive as the blades of the propeller strike the water. These force pulses give rise to torque pulses in the steering components. These momentary pulses are absorbed by the power steering system and the driver thus hardly senses them, but the various components of the drive are subjected to significant stresses. In drives with a steering arrangement of the type shown in, inter alia, SE 318 801, the steering fork and the helmet or bowl joined to the fork and the propeller leg must be dimensioned not only taking into account normal steering torques but the momentary quite high torque pulses transmitted by the propeller when driving at high speed through waves. This means that for example steering components of standard design for drive units intended for lower speed ranges are not necessarily suitable for the installations in question.

The purpose of the present invention is to provide a device of the type described by way of introduction which makes it possible to reduce stresses to the steering components of the drive.

This is achieved according to the invention by means of a shock absorber in the form of a piston-cylinder device, which at one end is articulated to the drive unit at a location remote from the steering pivot shaft and at the opposite end is articulated to a fixed part of the boat.

Marine trials have shown that a suitably dimensioned shock absorber installation of this type has made it possible to reduce the torque stresses to the steering components by one half without appreciably affecting the steering torque during normal steering movement.

The invention will be described below with reference to examples shown in the accompanying drawings.

DESCRIPTION OF THE PREFERRED EMBODIMENT

Figure 1:
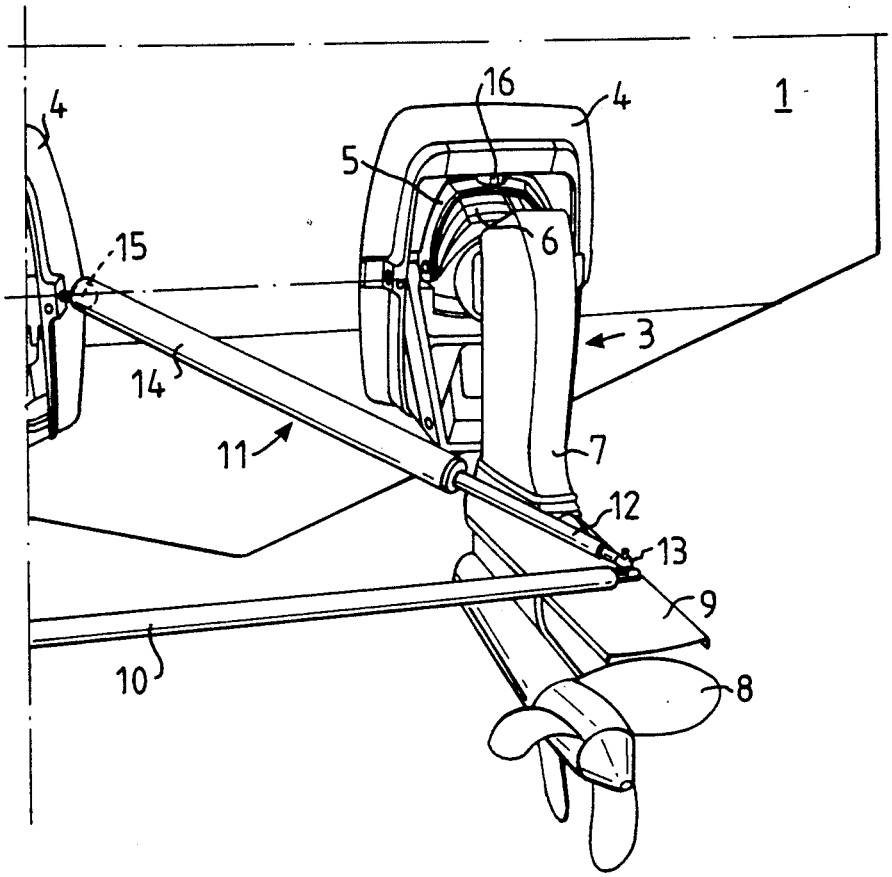
FIG. 1 shows a schematic perspective view of a portion of the stern of a boat with dual propeller drives.

In FIG. 1, 1 designates a portion of the transom of a boat, on which two stern drives have been mounted. One of the drives 3 is shown in its entirety whereas there is shown only a portion of the shield 4 of the other drive mounted on the transom. The drive can be of the type designated Aquamatic ® having a steering mechanism comprising a fork 5 joined to a steering arm and a helmet or hood 6 joined to the fork, to transmit the steering movements of the fork 5 to a propeller leg 7. For a more detailed description of the construction of the steering mechanism, reference is made to the above-mentioned SE 318 801.

The drives 3 are provided in a conventional manner with an anti-cavitation plate 9 mounted above the propeller 8. In order to synchronize the steering movements, a tie-bar 10 pivotally connects the anti-cavitation plates 9 to each other.

Figure 3:
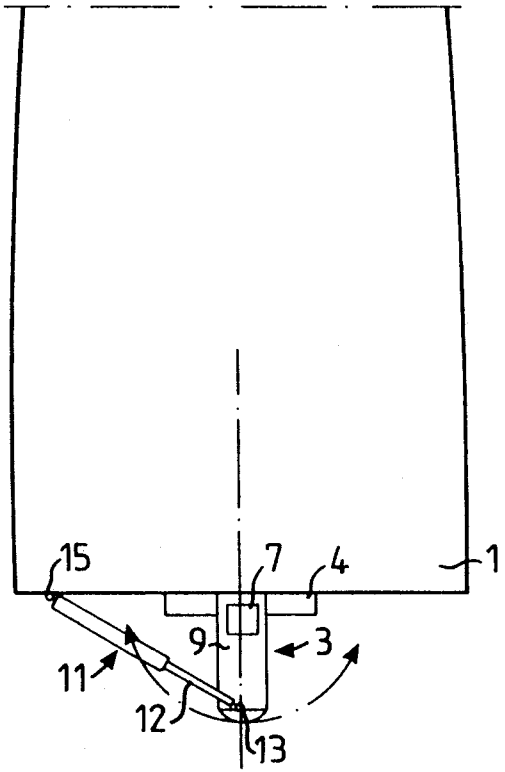
FIG. 3 is a view corresponding to FIG. 2 of a single drive installation.
Figure 2:
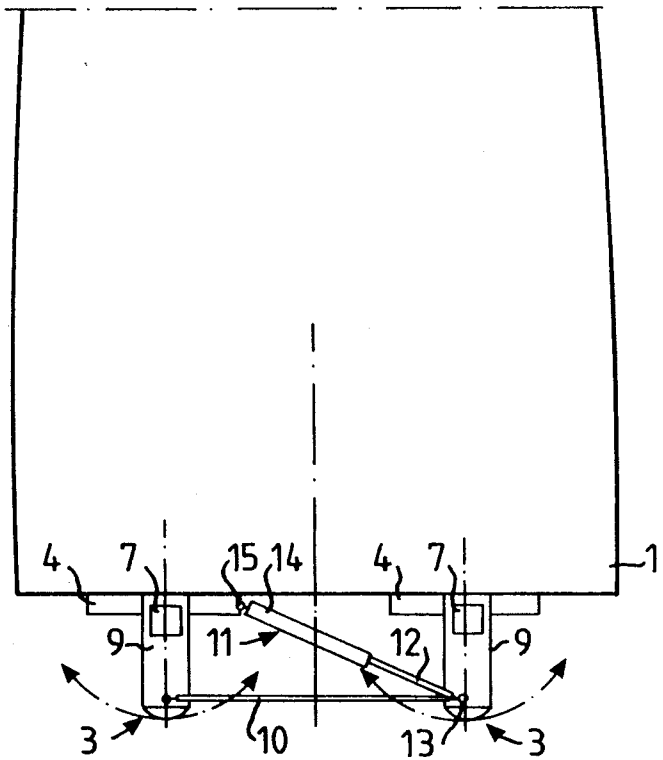
FIG. 2 is a schematic view from above of the installation in FIG. 1.

According to the invention, a shock absorber in the form of a piston-cylinder device 11 joins one drive 3 to a fixed portion of the boat transom 1. In the example shown in FIGS. 1 and 2, the piston rod 12 of the shock absorber is joined to the anti-cavitation plate 9 of the right hand drive via a ball joint 13, while the cylinder 14 is joined to the left hand drive shield 4 via a ball joint 15, lying on the tilting axis of the drive. Thus, the shock absorber 11 is not affected by the tilting movement. In the single drive model shown in FIG. 3, the ball joint 15 of the cylinder 14 is mounted directly on the boat transom 1.

The shock absorber 11 can have the same construction in principle as those used for automobile wheel suspensions, i.e. it can have a piston provided with valved oil channels, said piston being displaceable in a cylinder filled with oil, the resistance to displacement being determined by the constrictions in the channels.

Tests performed with a shock absorber dimensioned for speeds of 300 mm/s during the contraction and extension movements at a force of 2000 Nm±300 Nm and with a maximum length of 1120 mm and a minimum length of 700 mm demonstrated that the torque pulses generated by the propeller rotation in the steering components, e.g. the fork 5 and the helmet 6, could be reduced by up to 700 Nm. Comparative trials showed that the torque could be reduced from about 1300 Nm to about 600 Nm merely by providing an existing drive installation with a shock absorber according to the invention. A shock absorber with the specifications and length given above, i.e. a length corresponding to about two times the distance between the steering pivot shaft 16 and the ball joint 13 on the anti-cavitation plate, resulted in a negligible increase in resistance to normal steering movements, i.e. movements made relatively slowly.

We claim:

1. In a boat having a propeller leg having a propeller, said propeller leg being steerable about a substantially vertical steering pivot shaft and being tiltable about a horizontal tilt shaft and having an anti-cavitation plate mounted above the propeller; the improvement comprising a shock absorber in the form of a passive piston-cylinder device which at one end is articulated directly to the anti-cavitation plate at a location remote from the steering pivot shaft and at the opposite end is articulated to a fixed part of the boat at a point adjacent the axis of the horizontal tilt shaft.

2. Structure according to claim 1, wherein the distance between the articulation points of the shock absorber when the propeller leg is in a centered position is equal to about twice the distance between the steering pivot shaft and the point of attachment of the shock absorber to the anti-cavitation plate.

3. In a boat having twin propeller legs, each having a propeller, each said propeller leg being steerable about a substantially vertical steering pivot shaft and being tiltable about a horizontal tilt shaft and having an anti-cavitation plate mounted above the propeller; the improvement comprising a shock absorber in the form of a passive piston-cylinder device which at one end is articulated directly to one of the anti-cavitation plates of one of the propeller legs at a location remote from its steering pivot shaft, and at the opposite end is articulated to a fixed portion of the other of said propeller legs at a point adjacent the axis of its horizontal tilt shaft.

* * * * *